US010020113B2

(12) United States Patent
Tsukada et al.

(10) Patent No.: US 10,020,113 B2
(45) **Date of Patent: *Jul. 10, 2018**

(54) METHOD FOR PRODUCING RARE EARTH SINTERED MAGNET

(71) Applicant: HITACHI METALS, LTD., Tokyo (JP)

(72) Inventors: Takashi Tsukada, Omachi-cho (JP); Takuya Nansaka, Omachi-cho (JP); Satoru Kikuchi, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 777 days.

This patent is subject to a terminal disclaimer.

(21) Appl. No.: 14/411,266

(22) PCT Filed: Jun. 25, 2013

(86) PCT No.: PCT/JP2013/067335

§ 371 (c)(1),
(2) Date: Dec. 24, 2014

(87) PCT Pub. No.: WO2014/002983

PCT Pub. Date: Jan. 3, 2014

(65) Prior Publication Data

US 2015/0206655 A1 Jul. 23, 2015

(30) Foreign Application Priority Data

Jun. 29, 2012 (JP) ..... 2012-146704

(51) Int. Cl.
*B22F 3/12* (2006.01)
*H01F 41/02* (2006.01)
(Continued)

(52) U.S. Cl.
CPC ..... *H01F 41/0266* (2013.01); *B22F 3/12* (2013.01); *B30B 11/008* (2013.01);
(Continued)

(58) Field of Classification Search
CPC ..... B22F 3/12
See application file for complete search history.

(56) References Cited

U.S. PATENT DOCUMENTS 5,489,343 A 2/1996 Uchida et al.
6,413,457 B1 7/2002 Fukushima et al.
(Continued)

FOREIGN PATENT DOCUMENTS

JP 07-057914 A 3/1995
JP 10-241981 A 9/1998
(Continued)

OTHER PUBLICATIONS

International Search Report, dated Aug. 20, 2013, issued by the International Searching Authority in counterpart Application No. PCT/JP2013/067335.
(Continued)

*Primary Examiner* — Christopher Kessler
(74) *Attorney, Agent, or Firm* — Sughrue Mion, PLLC

(57) ABSTRACT

The present invention provides a method for producing a long and large-sized rare earth sintered magnet having a large size in a magnetic field application direction in which a single magnet body in each portion has uniform and high magnetic characteristics. Disclosed is a method for producing a rare earth sintered magnet, including particular steps of: 1) preparing a slurry; 2) preparing a cavity that is enclosed with a mold, an upper punch and a lower punch; 3) applying a magnetic field of 1.5 T or more in the cavity, and supplying the slurry at a flow rate of 20 to 600 $cm^3$/second, to fill the cavity with the slurry; 4) producing a molded body
(Continued)

of the alloy powder by press molding in the magnetic field; and 5) sintering the molded body.

4 Claims, 8 Drawing Sheets

(51) Int. Cl.

| | |
|---|---|
| ***C22C 38/00*** | (2006.01) |
| ***C22C 38/06*** | (2006.01) |
| ***C22C 38/10*** | (2006.01) |
| ***C22C 38/16*** | (2006.01) |
| ***B30B 11/00*** | (2006.01) |
| ***B30B 11/02*** | (2006.01) |
| *B22F 3/02* | (2006.01) |
| *H01F 1/057* | (2006.01) |

(52) U.S. Cl.

CPC ..... *B30B 11/027* (2013.01); *C22C 38/002* (2013.01); *C22C 38/005* (2013.01); *C22C 38/06* (2013.01); *C22C 38/10* (2013.01); *C22C 38/16* (2013.01); *H01F 41/0273* (2013.01); *B22F 3/02* (2013.01); *B22F 2998/10* (2013.01); *B22F 2999/00* (2013.01); *C22C 2202/02* (2013.01); *H01F 1/0577* (2013.01)

(56) References Cited

U.S. PATENT DOCUMENTS

| | | | |
|---|---|---|---|
| 2002/0192484 | A1 | 12/2002 | Kohara et al. |
| 2007/0176329 | A1 | 8/2007 | Saito et al. |

FOREIGN PATENT DOCUMENTS

| | | | |
|---|---|---|---|
| JP | 2000-353633 | A | 12/2000 |
| JP | 2001-058294 | A | 3/2001 |
| JP | 2001-093765 | A | 4/2001 |
| JP | 2004-281873 | A | 10/2004 |
| JP | 2008-218502 | A | 9/2008 |
| JP | 2008-243982 | A | 10/2008 |
| JP | 2009-016849 | A | 1/2009 |
| JP | 2010-215992 | A | 9/2010 |
| JP | 2011-216726 | A | 10/2011 |

OTHER PUBLICATIONS

Communication dated Mar. 8, 2016 from the European Patent Office in counterpart application No. 13810728.9.

International Preliminary Report on Patentability, dated Jan. 8, 2015, issued by the International Searching Authority in counterpart Application No. PCT/JP2013/067335.

[Fig. 1(a)]
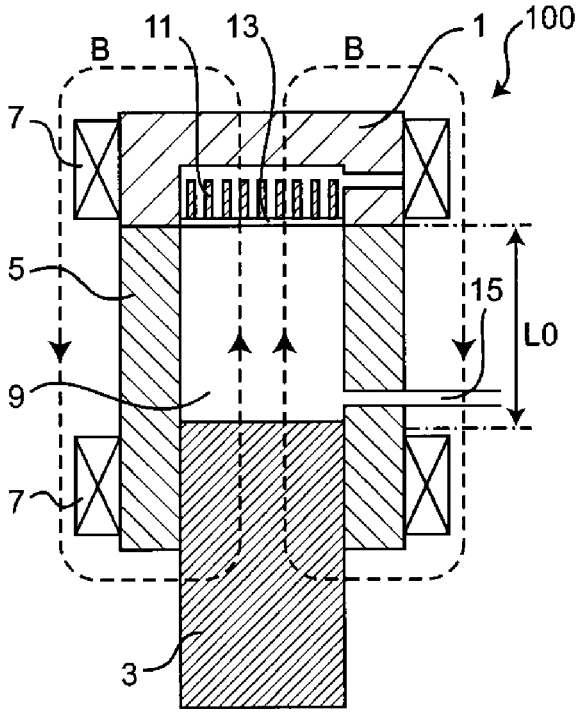

[Fig. 1(b)]
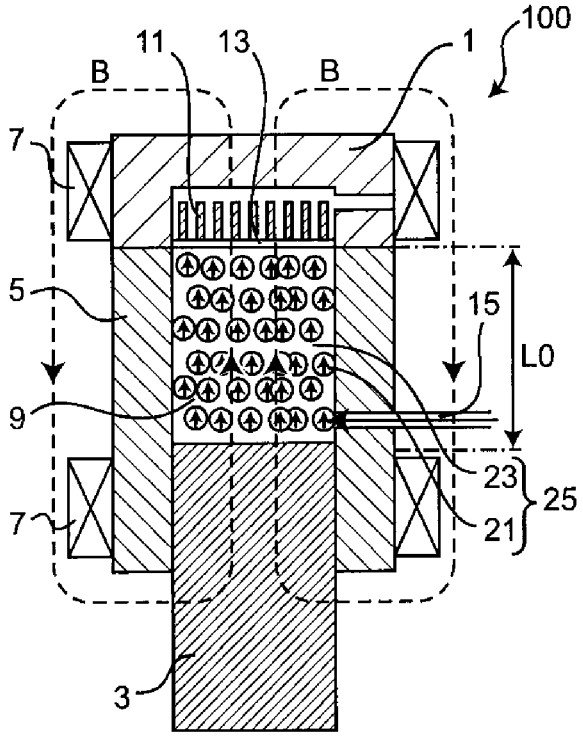

[Fig. 1(c)]
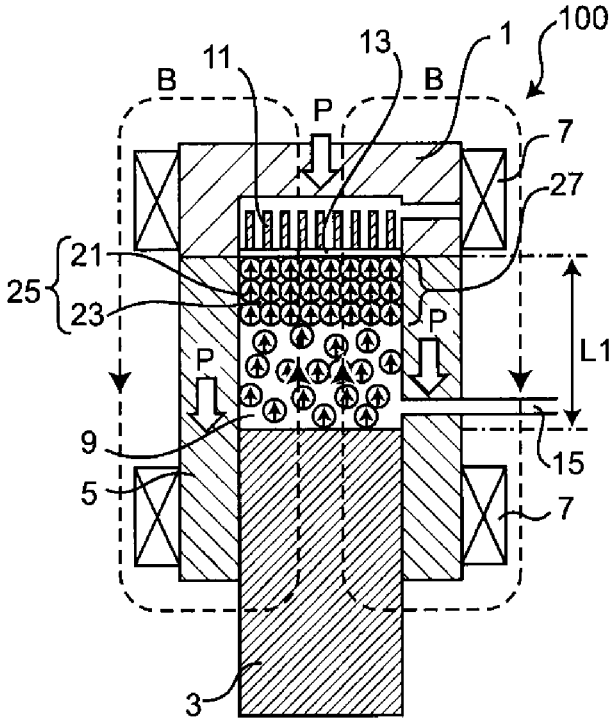

[Fig. 1(d)]
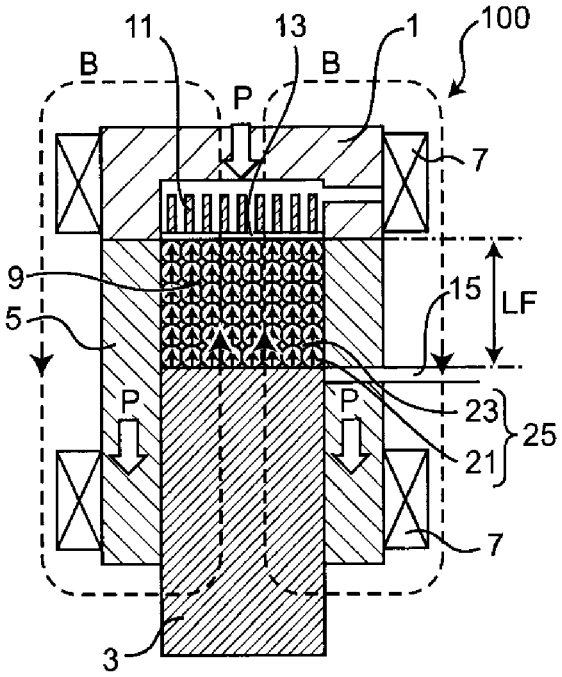

[Fig. 2]
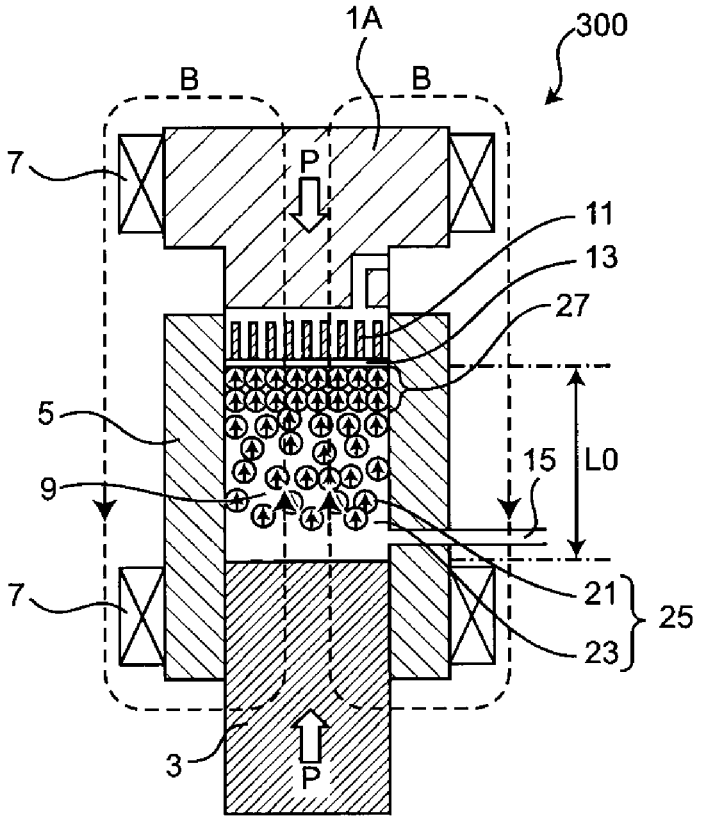

[Fig. 3]
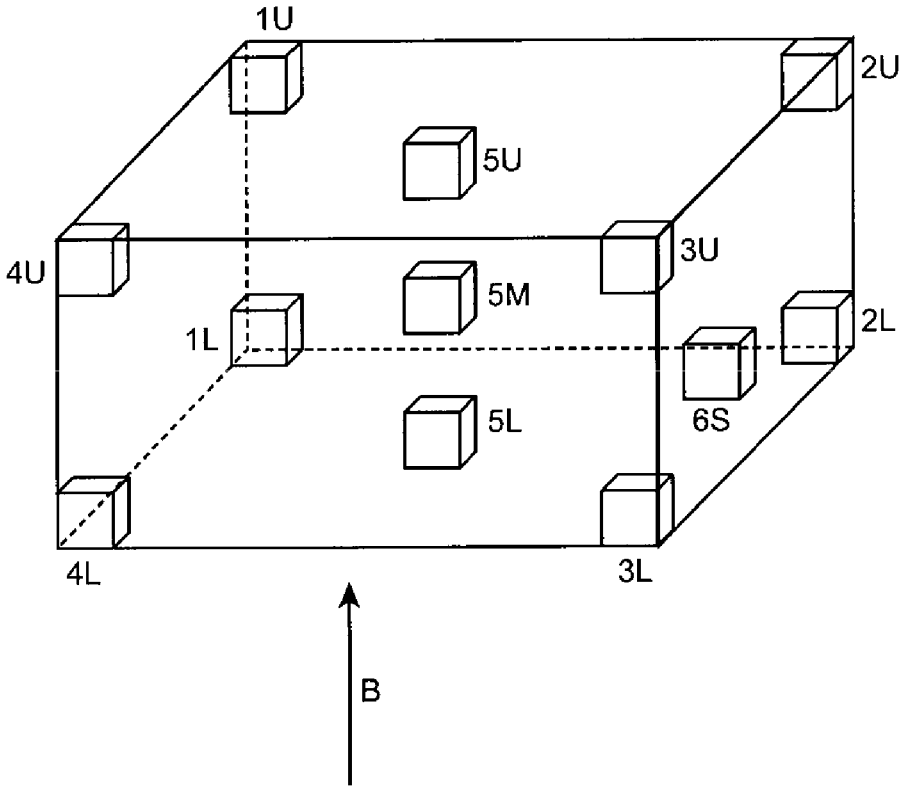

[Fig. 4]
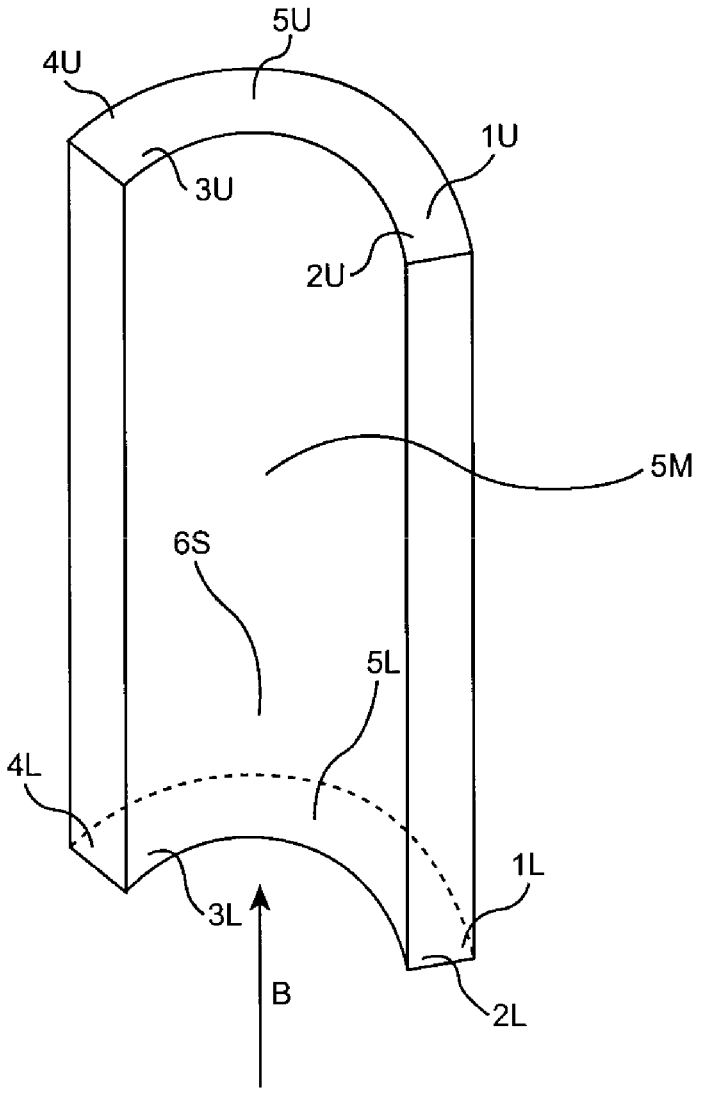

[Fig. 5]
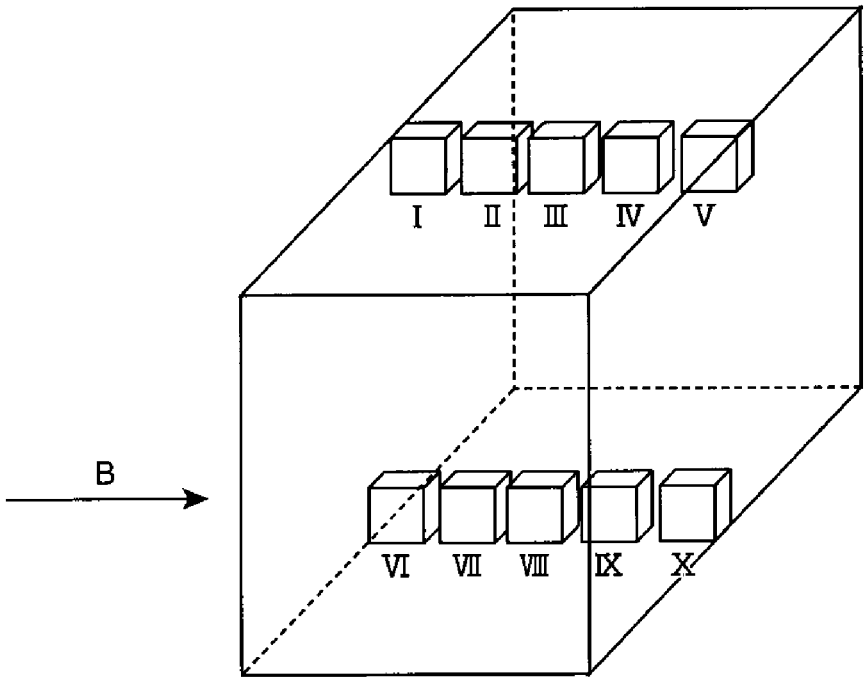

METHOD FOR PRODUCING RARE EARTH SINTERED MAGNET

CROSS REFERENCE TO RELATED APPLICATIONS

This application is a National Stage of International Application No. PCT/JP2013/067335 filed Jun. 25, 2013 (claiming priority based on Japanese Patent Application No. 2012-146704 filed Jun. 29, 2012), the contents of which are incorporated herein by reference in their entirety.

TECHNICAL FIELD

The present invention relates to a method for producing a rare earth sintered magnet, particularly, a method for producing a rare earth sintered magnet using a wet molding method.

BACKGROUND ART

Rare earth sintered magnets, such as R-T-B-based sintered magnets (R means at least one of rare earth elements (concept including yttrium (Y)), T means iron (Fe) or a combination of iron and cobalt (Co), and B means boron) and samarium-cobalt-based sintered magnets are widely used because of excellent magnetic characteristics such as a residual magnetic flux density $B_r$ (hereinafter sometimes simply referred to as "$B_r$") and a coercive force $H_{cj}$ (hereinafter sometimes simply referred to as "$H_{cj}$").

Particularly, R-T-B-based sintered magnets are used for various applications, including various motors such as voice coil motors of hard disk drives, motors for hybrid vehicles, motors for electric vehicles, and home electric appliances, because of the highest magnetic energy product among various conventionally known magnets and the affordable low price. There have recently been demands for more improvement in magnetic characteristics of rare earth sintered magnets such as R-T-B-based sintered magnets for the sake of size reduction and weight reduction or increase in efficiency for various usages The R-T-B-based sintered magnet includes, as a main phase, an $R_2T_{14}B$ phase which is a ferromagnetic phase, and also has a structure in which a non-magnetic low-melting point R-rich phase of a concentrated rare earth element (R) coexists. There have been known, as the method for improving magnetic characteristics of the R-T-B-based sintered magnet, methods in which (1) an $R_2T_{14}B$ phase is refined, (2) the orientation degree of an $R_2T_{14}B$ phase is enhanced, (3) the amount of oxygen is reduced, and (4) a ratio of an $R_2T_{14}B$ phase is increased.

In the production of numerous rare earth sintered magnets including an R-T-B-based sintered magnet, it is possible to use an ingot obtained by melting (fusing) raw materials such as metals and casting the molten metal into a mold, or an alloy powder having a predetermined particle diameter obtained by grinding a raw material alloy cast material with the desired composition such as a strip obtained by a strip casting method. The alloy powder is subjected to press molding (press molding in a magnetic field) to obtain a molded body (green compact) and also the molded body is sintered to produce numerous rare earth sintered magnets including an R-T-B-based sintered magnet.

In the case of obtaining an alloy powder from a casting material, in many cases, steps to be used are two grinding steps of a coarsely grinding step of grinding into a coarse powder having a large particle diameter (coarsely ground powder) and a finely grinding step of further grinding the coarse powder into an alloy powder having a desired particle diameter.

The method of press molding (press molding in a magnetic field) is roughly classified into two methods. One is a dry molding method in which the obtained alloy powder is subjected to press molding in a dry state. The other one is a wet molding method mentioned, for example, in Patent Document 1, in which an alloy powder is dispersed in a dispersion medium such as oil to prepare a slurry, and the alloy powder is supplied in a cavity of a mold in a state of the slurry, followed by press molding.

Furthermore, the dry molding method and the wet molding method can be roughly classified into two methods, respectively, according to a relation between the pressing direction at the time of pressing in a magnetic field and the direction of the magnetic field. One is a perpendicular magnetic field molding method (also referred to as a "transverse magnetic field molding method") in which the direction of compression preformed by a press (pressing direction) is orthogonal to the direction of the magnetic field applied to an alloy powder. The other one is a parallel magnetic field molding method in which the pressing direction is in parallel with the direction of a magnetic field applied to an alloy powder (also referred to as a "longitudinal magnetic field molding method").

The dry molding method is often employed since a molding machine has a comparatively simple structure, and steps such as removal of dispersion medium during press molding and removal of the dispersion medium from the molded body are not needed. Particularly, according to the perpendicular magnetic field molding method, since the pressing direction is orthogonal to the magnetic field application direction, press molding can be performed without drastically disturbing the orientation of the alloy powder oriented to the magnetic field application direction, thus enabling production of a molded body having high orientation degree of an $R_2T_{14}B$ phase. Meanwhile, according to the parallel magnetic field molding method, since the pressing direction is in parallel with the magnetic field application method, the orientation of the alloy powder is likely to be disturbed at the time of press molding, and thus the $R_2T_{14}B$ phase exhibits low orientation degree as compared with the perpendicular magnetic field molding method. Therefore, in the dry molding method, the perpendicular magnetic field molding method is mainly used, and only a product having a shape such as disc, ring or thin sheet, which is difficult to mold by the perpendicular magnetic field molding method, is produced by the parallel magnetic field molding method.

However, in the dry molding method, exposure of an alloy powder to the atmospheric air is unavoidable when the alloy powder is supplied in a cavity and press molding is performed, and also a molded body is exposed to the atmospheric air when the molded body is removed after completion of press molding, thus causing an increase in the amount of oxygen of the molded body, leading to deterioration of magnetic characteristics. It is difficult to avoid producing large friction between alloy powders or between an alloy powder and a mold, and also there is a limitation on increase in orientation degree of the $R_2T_{14}B$ phase because of large resistance when the alloy powder is rotated and orientated by the applied magnetic field.

Meanwhile, there is a need for the wet molding method to perform supply of a slurry and removal of a dispersion medium, and thus the structure of a molding machine becomes comparatively complicated. However, oxidation of the alloy powder and the molded body is suppressed by the dispersion medium, thus enabling reduction in the amount of oxygen of the molded body. The dispersion medium exists between alloy powders at the time of press molding in the magnetic field, and thus the alloy powder can rotates more easily in the magnetic field application direction because of weak restriction due to a friction force. Therefore, higher orientation degree can be obtained. Thus, there is an advantage that it is possible to obtain a rare earth sintered magnet which is more excellent in magnetic characteristics as compared with the dry molding method.

In this way, it is possible to obtain high orientation degree and excellent oxidation suppressing effect as compared with the dry molding method when the wet molding method is used, and the R-T-B-based sintered magnet thus obtained tends to have higher magnetic characteristics. High orientation degree and excellent oxidation suppressing effect obtained using the wet molding method can be obtained in not only this R-T-B-based sintered magnet, but also other rare earth sintered magnets.

However, the wet molding method also has the following problems.

In the wet molding method, when the slurry is charged in a cavity and press molding is performed in the magnetic field, there is a need for most of a dispersion medium (oil, etc.) in the slurry to be discharge out of the cavity. Usually, at least one of an upper punch and a lower punch is provided with a dispersion medium outlet and, when the volume of the cavity decreases by the movement of the upper punch and/or the lower punch to pressurize the slurry, the dispersion medium is discharged through the dispersion medium outlet. In this case, since the dispersion medium in the slurry is filtered and discharged from the portion close to the dispersion medium outlet, a layer called a "cake layer" having increased concentration (high density) of the alloy powder is formed at the portion close to the dispersion medium outlet in an initial stage of press molding.

As the upper punch and/or the lower punch move(s) and press molding proceeds, much more dispersion medium is filtered and discharged, and thus an area of the cake layer spreads in the cavity. Finally, the cake layer (having high density of the alloy powder (low dispersion medium concentration) spreads all over the cavity, resulting in achieving bonding between the alloy powders (comparatively weak bonding) to obtain a molded body.

In the initial stage of press molding, when the cake layer is formed at the portion close to the dispersion medium outlet (upper portion and/or lower portion in the cavity), the direction of the magnetic field tends to be curved in the perpendicular magnetic field molding method.

The cake layer exhibits increased magnetic permeability as compared with the portion other than the cake layer of the slurry (portion with less amount of the alloy powder per unit volume) because of high density of the alloy powder (large amount of the alloy powder per unit volume), thus causing focusing of the magnetic field in the cake layer. This means the fact that, even if the magnetic field is applied approximately perpendicularly to the cavity side surface outside the cavity, the magnetic field is curved to the cake layer inside the cavity. Therefore, since the alloy powder is oriented along this curved magnetic field, the portion with curved orientation exists in the molded body after press molding, leading to a decrease in orientation degree in the single molded body, thus failing to obtain sufficient magnetic characteristics in the sintered magnet.

A problem of deterioration of magnetic characteristics of the rare earth sintered magnet due to curved magnetic field becomes noticable as the size of the cavity in the magnetic field application direction increases, for example, more than 10 mm.

Meanwhile, in the parallel magnetic field molding method, since the magnetic field is applied to the direction parallel to the pressing direction, i.e. the direction parallel to the direction from the upper punch toward the lower punch, even if the cake layer is formed at the portion close to the dispersion medium outlet of the upper punch and/or the lower punch, the magnetic field travels straight toward the inside of the cake layer from the portion where the cake layer does not exist without being curved. Therefore, like the perpendicular magnetic field molding method, the magnetic field is not restricted by the size of the cavity in the magnetic field application direction.

However, when the size of the cavity in the magnetic field application direction increases, since a distance between coils serving as a generation source of the magnetic field increases, the strength of the magnetic field applied into the cavity decreases, and thus the orientation degree of the alloy powder decreases. Therefore, the magnetic field strength must be increased in case the size of the magnetic field application direction is increased. In order to solve a problem that the orientation of the alloy powder is likely to disturbed at the time of press molding since the pressing direction is in parallel with the magnetic field application method, it is effective to increase the magnetic field strength.

However, even if the magnetic field strength is increased, the desired magnetic characteristics cannot be obtained sometimes. Particularly, in case an attempt is made to obtain a long and large-sized molded body having a large size of the cavity in the magnetic field application direction, variation in density in each portion of the molded body tends to occur. This is a problem peculiar to the wet molding method, and the same problem may occur in the perpendicular magnetic field molding method. When variation in density in each portion of the molded body occurs, there arise problems that cracks generate in the molded body at the time of removing the molded body after press molding, and that cracks generate due to shrinkage at the time of sintering.

Under these circumstances, a parallel magnetic field molding method using a wet molding method is known in documents such as Patent Document 1, however, the parallel magnetic field molding method was not used in the production of a long molded body or a large-sized molded body in which the size of the cavity (depth size of the cavity) in the magnetic field application direction has a large value of more than 10 mm in actual manufacturing site. In other words, there has never been produced a rare earth sintered magnet, which is obtained from a molded body in which the size of the cavity (depth size of the cavity) in the magnetic field application direction is more than 10 mm, and has uniform and high magnetic characteristics, by the wet molding method.

There has conventionally been produced a molded body having a large size in the magnetic field application direction mainly by the perpendicular magnetic field molding method using a dry molding method. For example, as disclosed in Patent Document 2, a magnet for voice coil motors of a hard disk drive has been produced by subjecting a long molded body having a shape, a cross section of which is composed of an approximately arc-shaped outer circumference, an approximately arc-shaped inner circumference, and a pair of side circumferences connecting between the outer circumference and the inner circumference (hereinafter referred to as an "approximately arc shape"), to press molding, followed by sintering and further slicing in the direction orthogonal to the magnetic field application direction.

However, as mentioned above, in the dry molding method, the amount of oxygen of the molded body increases to cause deterioration of magnetic characteristics, and also there is a limitation on an increase in orientation degree of the $R_2T_{14}B$ phase. Also in the perpendicular magnetic field molding method using the dry molding method, there is a limitation on the size of the magnetic field application method.

Therefore, although a comparatively simple shape such as rectangular parallelepiped can be produced by the method, it is difficult to form a complicate shape having an approximately arc-shaped cross section. Even if the complicate shape can be formed by the method disclosed in Patent Document 2, sufficient magnetic characteristics could not be often obtained.

Furthermore, it was impossible to produce a long molded article, which is used as a magnet for voice coil motors of a hard disk drive in recent days, having a large size in the magnetic field application direction and also having a complicated cross-sectional shape in the direction orthogonal to the magnetic field application direction, for example, a shape whose cross section has an approximately arc shape, protrusions being formed on at least a part of an outer R surface (approximately arc-shaped outer peripheral surface), an inner R surface (approximately arc-shaped inner peripheral surface) and an arc end face, by the dry molding method.

Patent Document 1: JP 7-57914 A
Patent Document 2: JP 2001-58294 A

DISCLOSURE OF THE INVENTION

Problems to be Solved by the Invention

An object of the present invention is to provide a long or large-sized rare earth sintered magnet having a large size in a magnetic field application direction in which a single magnet body in each portion has uniform and high magnetic characteristics.

Another object of the present invention is to provide a method for producing a rare earth sintered magnet in which the size is large in a magnetic field application direction, and a cross section in the direction orthogonal to the magnetic field application direction has a complicated shape.

Means for Solving the Problem

A first aspect of the present invention is directed to a method for producing a rare earth sintered magnet, including the steps of: 1) preparing a slurry that contains an alloy powder containing a rare earth element, iron, and boron, and a dispersion medium at a predetermined ratio; 2) preparing a cavity that is enclosed with a mold, and an upper punch and a lower punch, at least one of which is movable toward and away from the other one in the mold, and also includes an outlet for discharging the dispersion medium of the slurry; 3) applying a magnetic field of 1.5 T or more in the cavity in the direction parallel to the direction in which at least one of the upper punch and the lower punch is movable, and supplying the slurry at a flow rate of 20 to 600 $cm^3$/second to fill the cavity with the slurry; 4) producing a molded body of the alloy powder by press molding in the magnetic field in which the upper punch and the lower punch come closer to each other while applying the magnetic field; and 5) sintering the molded body.

A second aspect of the present invention is directed to the method for producing a rare earth sintered magnet according to the first aspect, wherein the flow rate of the slurry is within a range of 20 to 400 $cm^3$/second.

A third aspect of the present invention is directed to the method for producing a rare earth sintered magnet according to the first aspect, wherein the flow rate of the slurry is within a range of 20 to 200 $cm^3$/second.

A fourth aspect of the present invention is directed to the method for producing a rare earth sintered magnet according to any one of the first to third aspects, wherein, in the direction in which at least one of the upper punch and the lower punch is movable, a ratio (L0/LF) of the length (L0) of a cavity before press molding in the magnetic field to the length (LF) of the molded body is within a range of 1.1 to 1.4.

A fifth aspect of the present invention is directed to the method for producing a rare earth sintered magnet according to any one of the first to fourth aspects, wherein the alloy powder in the slurry has a concentration of 70 to 90% by mass.

A sixth aspect of the present invention is directed to the method for producing a rare earth sintered magnet according to the fifth aspect, wherein the alloy powder in the slurry has a concentration of 84% by mass or more.

Effects of the Invention

According to the present invention, it is possible to provide a long or large-sized rare earth sintered magnet having a large size in a magnetic field application direction in which a single magnet body in each portion has uniform and high magnetic characteristics.

According to the present invention, it is also possible to provide a method for producing a rare earth sintered magnet in which the size is large in a magnetic field application direction, and a cross section in the direction orthogonal to the magnetic field application direction has a complicated shape.

BRIEF DESCRIPTION OF THE DRAWINGS

FIG. 1(*a*) is a schematic view showing a method for producing a rare earth sintered magnet of the present invention.

FIG. 1(*b*) is a schematic view showing a method for producing a rare earth sintered magnet of the present invention.

FIG. 1(*c*) is a schematic view showing a method for producing a rare earth sintered magnet of the present invention.

FIG. 1(*d*) is a schematic view showing a method for producing a rare earth sintered magnet of the present invention.

FIG. 2 is a schematic view showing another embodiment of a press in a magnetic field.

FIG. 3 is a schematic explanatory view showing the shape and the sampling position of a rare earth sintered magnet of Example 1 according to the present invention.

FIG. 4 is a schematic explanatory view showing the shape and the sampling position of a rare earth sintered magnet of Example 2 according to the present invention.

FIG. 5 is a schematic explanatory view showing the shape and the sampling position a rare earth sintered magnet according to Comparative Example 3.

MODE FOR CARRYING OUT THE INVENTION

Embodiments according to the present invention will be described in detail below with reference to the accompanying drawings. In the description below, if necessary, the terms indicative of the specific direction or position (for example, "upper", "lower", "right", "left", and other words including these words) are used for easy understanding of the invention with reference to the drawings. The meanings of the terms do not limit the technical range of the invention. In the following embodiments, the same parts or members are designated by the same reference numerals throughout plural drawings.

In case a cavity has a large depth size in a parallel magnetic field molding method using a wet molding method, the magnetic field strength has hitherto been increased so as to prevent deterioration of the orientation degree of an alloy powder, and thus magnetic characteristics cannot be more improved only by increasing the magnetic field strength, as mentioned above.

Therefore, the inventors have intensively studied and found that, using a parallel magnetic field molding method, a molded body is produced by supplying a slurry in a cavity at a flow rate within a range of 20 $cm^3$/second to 600 $cm^3$/second in a state where a magnetic field of 1.5 T or more is applied in the cavity, whereby, variation in density in each portion of the molded body is almost eliminated, and the rare earth sintered magnet thus obtained from the molded body has uniform magnetic characteristics in each portion (little variation in magnetic characteristics due to difference in site of a magnet) and also has high magnetic characteristics. Thus, the present invention has been completed.

As mentioned above, to begin with, there has never been produced a molded body, in which the size of cavity (depth size of cavity) in the magnetic field application direction exceeds 10 mm, by a wet molding method. Therefore, there was no need to apply a magnetic field of 1.5 T or more. In a conventional wet molding method, since great importance is placed on the fact that a slurry is supplied as quick as possible (slurry flow rate is increased) for the improvement in production efficiency, there has never been any technical idea of adjustment of the supply amount of the slurry to comparatively small value of 600 $cm^3$/second or less.

Although the reason why, variation in density in each portion of the obtained molded body is almost eliminated by adjusting the supply amount of a slurry within a range of 20 to 600 $cm^3$/second in a state where a magnetic field of 1.5 T or more is applied, is unclear, the reason estimated by the inventors is as follows.

It should be noted that this reason is estimated based on findings obtained at present and is not intended to limit the technical scope of the present invention.

In case the slurry is supplied in the cavity to which a magnetic field of 1.5 T or more is applied, the upper punch surface and the lower punch surface serve as a magnetic pole in the cavity, thus estimating that the slurry supplied from the vicinity of the lower punch (particularly, the alloy powder in the slurry) is oriented in the magnetic field direction, and is also attracted to the lower punch surface, leading to accumulation in the form of a mountain. When the slurry is further supplied, additionally supplied slurry (particularly, the alloy powder in the slurry) is accumulated so as to push up the mountain, thus finally filling the cavity with the slurry.

The reason why, numerous variations in density in each portion of the molded body occurred in the case of a long or large-sized molded body having a large size in the magnetic field application direction, is considered as follows. In case the slurry is accumulated in the form of a mountain, an alloy powder which is a solid is separated from a dispersion medium which is a liquid (solid-liquid separation) by attracting the alloy powder in the slurry to the lower punch surface, and the thus separated dispersion medium aggregates around the cavity (foot of the mountain).

In other words, when the slurry is supplied (so as to push up the mountain) in such state to fill the cavity with the slurry, followed by press molding, press molding is performed in a state where the density of the alloy powder (amount of the alloy powder existing per unit volume) is low at the upper portion and peripheral portion of the cavity as compared with the center and bottom of the cavity. Therefore, it is considered that the density of the upper portion and peripheral portion of the obtained molded body becomes lower than that of the center and bottom. Variation in density in each portion of the molded body leads to deterioration of magnetic characteristics and variation with the position of the sintered magnet obtained by sintering the molded body.

Furthermore, such variation in density may cause generation of cracks in the molded body at the time of the removal of the molded body after press molding and, even if the molded body is free from cracks, cracks may sometimes occur due to shrinkage at the time of sintering.

In case the slurry is supplied in the cavity in a state where the magnetic field of 1.5 T or more is applied, it is considered, when the slurry is supplied in the cavity at comparatively large flow rate in the same manner as in a conventional molding method in which the magnetic field strength is less than 1.5 T, solid-liquid separation drastically occurs to cause numerous variations in density in each portion of the molded body.

In the present invention, the supply amount of the slurry is smaller than usual, for example, 20 $cm^3$/second to 600 $cm^3$/second, and thus it is considered that solid-liquid separation is suppressed. Therefore, variation in density in each portion of the molded body is almost eliminated, and thus it is considered that it is possible to obtain a long or large-sized rare earth sintered magnet having a large size in the magnetic field application direction, which has uniform and high magnetic characteristics in each portion of a single magnet body.

The inventors have also found the followings. In a conventional production method with large slurry flow rate, since a large amount of the slurry flows into through a slurry supply inlet, an alloy powder oriented in the direction parallel to the magnetic field in the vicinity of the slurry supply inlet is pushed aside (removed), particularly at the last stage of slurry supply (immediately before the cavity is completely filled with a slurry), thus disturbing the orientation of the alloy powder. The inventors have also found that the portion with disturbed orientation in the vicinity of the slurry supply inlet is converted into a rare earth sintered magnet through the steps of press molding, deoiling treatment, sintering and heat treatment as it is (while being in a state where the orientation is disturbed), thus causing deterioration of magnetic characteristics of this portion as compared with the other portion. Deterioration of magnetic characteristics caused by disturbing of the orientation in the vicinity of the slurry supply inlet becomes more remarkable in case a long or large-sized molded body having large depth size of the cavity is subjected to press molding.

In the present invention, since the supply amount of the slurry is smaller than usual, for example, 20 $cm^3$/second to 600 $cm^3$/second, and thus it is considered that an influence on an alloy powder oriented in the magnetic field direction is limitative and the orientation in the vicinity of a slurry supply inlet is less disturbed. As a result, according to the present invention, it is possible to obtain a long or large-sized rare earth sintered magnet having a large size in the magnetic field application direction, which causes extremely little deterioration of the portion corresponding to the vicinity of the slurry supply inlet, and uniform and high magnetic characteristics in each portion of a single magnet body.

With respect to the fact that magnetic characteristics of the obtained sintered magnet are improved by adjusting the supply amount of the slurry within a range of 20 $cm^3$/second to 600 $cm^3$/second, the reason estimated by the inventors includes, as mentioned above, two reasons of (1) density of the molded body becomes uniform, and (2) disturbing of orientation of an alloy powder in the vicinity of a slurry supply inlet can be suppressed. The inventors estimate that at least one of these two reasons contributes.

1. Molding

A molding step according to the method for producing a rare earth sintered magnet of the present invention will be described in detail below.

FIGS. 1(*a*) to 1(*d*) are schematic views showing a method for producing a rare earth sintered magnet of the present invention. Hereinafter, FIGS. 1(*a*) to 1(*d*) are sometimes collectively referred to as "FIG. 1".

FIG. 1(*a*) is a schematic view showing a molding apparatus 100 before supplying a slurry. The molding apparatus 100 includes a cavity 9 enclosed by a throughhole of a mold 5, and an upper punch 1 and a lower punch 3.

(1) Molding Apparatus

The cavity 9 has a length L0 extending in a molding direction. Here, the molding direction means a direction in which at least one of the upper punch and the lower punch travels in order to come close to the other one (i.e., a pressing direction or a sliding direction).

According to the embodiment shown in FIG. 1, as mentioned below, the lower punch 3 is fixed, and the upper punch 1 and the mold 5 travel integrally. Therefore, in FIG. 1, the molding direction is a direction in which the upper punch and the mold travel from top to bottom (direction of an arrow P of FIG. 1(*c*) and FIG. 1(*d*)).

An electromagnet 7 is disposed on each of a side surface of the upper punch 1 and each of a lower side surface of the mold 3. Each of dashed lines B schematically indicates a magnetic field which is created by the individual electromagnet 7. As indicated by an arrow on each dashed line B, the magnetic field is applied in the cavity 9 in a direction in parallel with a bottom-to-top direction, i.e., the molding direction, of FIG. 1.

The strength of the magnetic field is preferably 1.5 T or more. The reason is that, when the slurry is injected into the cavity 9, a magnetization direction of the alloy powder in the slurry is more securely oriented in a direction of the magnetic field, thus obtaining high degree of orientation. When the strength is less than 1.5 T, the degree of orientation of the alloy powder deteriorates and/or orientation of the alloy powder is likely to be scattered at the time of press molding. The strength of the magnetic field in the cavity 9 can be determined by measurement by a Gauss meter or magnetic field analysis.

Preferably, the electromagnets 7 are disposed, as shown in FIG. 1, so that the electromagnets 7 enclose the side surfaces of the upper punch 1 and the lower side surfaces of the mold 5. This is because such positioning enables formation of the magnetic fields which are uniform and in parallel with the molding direction in the cavity 9. The term "in parallel with the molding direction" includes not only in case the magnetic fields are oriented from the lower punch 3 to the upper punch 1 (from the bottom to the top in the drawing) as shown in FIG. 1 but also in case the magnetic fields are oriented oppositely, i.e., from the upper punch 1 to the lower punch 3 (from the top to the bottom of the drawing).

The cavity 9 is connected to the inlet 15 for injecting the slurry into the cavity 9. In the embodiment shown in FIG. 1, a passage passing through the mold 5 functions as the inlet 15. The supply inlet 15 is connected to a slurry supply device (not shown) (hydraulic system including a hydraulic cylinder) and the slurry 25 pressurized by a hydraulic cylinder is supplied to the cavity 9 though a supply inlet 15.

The upper punch 1 preferably includes a dispersion medium outlet 11 that filters to discharge the dispersion medium in the slurry out of the cavity 9. In a more preferable embodiment, the upper punch 1 includes a plurality of dispersion medium outlets 11 as shown in FIG. 1.

In case the upper punch 1 includes the dispersion medium outlet 11, the upper punch 1 preferably has a filter 13, e.g., a filter cloth, a filter paper, a porous filter or a metal filter, so that the filter 13 covers the dispersion medium outlet 11. This prevents the alloy powder from coming into the dispersion medium outlet 11 more securely (i.e. only the dispersion medium passes through), thus making it possible to filter the dispersion medium in the slurry to discharge out of the cavity 9.

Instead of or in addition to the provision of the dispersion medium outlet 11 in the upper punch 1, the lower punch 3 may be provided with the dispersion medium outlet 11. As mentioned above, when the dispersion medium outlet 11 is provided in the lower punch 3, preferably, the filter 13 is disposed so as to cover the dispersion medium outlet 11.

(2) Injection of Slurry

Next, the slurry 25 is supplied in a cavity 9 at a flow rate of 20 to 600 $cm^3$/second (supply rate of a slurry). When the flow rate is 20 $cm^3$/second or less, it is difficult to adjust the flow rate. This is because there is in case the slurry cannot be injected into the cavity due to pipe resistance. On the other hand, when the flow rate exceeds 600 $cm^3$/second, as mentioned above, variation in density occurs at portions of the molded body, thus causing breakage of the molded body when the molded body is removed after the press molding, or breakage of the molded body due to shrinkage when the molded body is sintered. This is also because disorder of orientation occurs in the vicinity of the slurry inlet.

A flow rate of a slurry is preferably within a range of 20 $cm^3$/second to 400 $cm^3$/second, and more preferably 20 $cm^3$/second to 200 $cm^3$/second. When the flow rate is controlled within a preferable range and a more preferable range, variation in density in portions of the molded body can be further reduced.

The flow rate of a slurry can be controlled by adjusting a flow rate control valve of a hydraulic system having a hydraulic cylinder as a slurry to change the flow rate of oil to be fed into the hydraulic cylinder and thus to change a rate of hydraulic cylinder.

FIG. 1(*b*) is a schematic cross-sectional view showing a state where a cavity 9 is filled with the supplied slurry 25. The slurry 25 contains an alloy powder 21 containing a rare earth element and a dispersion medium 23 such as oil. As shown in FIG. 1(*b*), the upper punch 1 and the lower punch 3 are in a stationary state, and thus the length in the molding direction of the cavity 9 (i.e., the distance between the upper punch 1 and the lower punch 3) remains constant at L0. The magnetic field, which is the same as in FIG. 1(*a*), is applied in the cavity 9.

The slurry is preferably supplied under a pressure of 1.96 MPa to 14.7 MPa (20 $kgf/cm^2$ to 150 $kgf/cm^2$).

The supply inlet 15 preferably has a diameter of 2 mm to 30 mm.

A magnetization direction of the alloy powder 21 of the slurry 25 supplied in the cavity 9 becomes in parallel with the direction of the magnetic field, i.e., in parallel with the molding direction, due to the magnetic field of 1.5 T or more applied in the cavity. In FIG. 1(*b*) to FIG. 1(*d*), arrows in the alloy powder 21 schematically indicate the magnetization direction of the alloy powder 21.

(3) Press Molding

The press molding is performed after the cavity 9 is filled with the supplied slurry 25 in this way.

FIG. 1(*c*) and FIG. 1(*d*) are schematic cross-sectional view schematically showing press molding.

FIG. 1(*c*) shows a state where compression is performed until the length of the cavity 9 in molding direction becomes L1 (L0>L1), and FIG. 1(*d*) shows a state where compression is performed until the length of the cavity 9 in molding direction becomes LF (L1>LF) which is the length of the molded article to be obtained.

The press molding is performed so that at least one of the upper punch 1 and the lower punch 3 is moved to cause the upper punch 1 and the lower punch 3 to come close to each other, whereby, the volume of the cavity 9 is reduced. In the embodiment as shown in FIG. 1(*c*) and FIG. 1(*d*), the lower punch 3 is fixed and the upper punch 1 and the mold 5 integrally travels in the direction of an arrow P in the drawings (from the top to the bottom in the drawings), thus performing press molding.

As shown in FIG. 1(*c*), when the press molding is performed in the magnetic field and thus the volume of the cavity 9 decreases, the dispersion medium 23 in the slurry 25 is filtered to discharge through the dispersion medium outlet 11 from the portion close to the dispersion medium outlet 11. On the other hand, the alloy powder 21 remains in the cavity 9 to form a cake layer 27 from the portion close to the dispersion medium outlet 11. Thereafter, as shown in FIG. 1(*d*), the cake layer 27 spreads all over the cavity 9, resulting in achieving bonding between the alloy powders 21 to obtain a molded body in which the length in the molding direction (length in the compression direction) is LF. As used herein, "cake layer" means a layer of which concentration of alloy powder becomes high due to filtering and discharge of the dispersion medium in the slurry to the outside of the cavity 9 (in a so-called cake-shaped state in many cases).

In the press molding in magnetic field according to the present invention, a ratio (L0/LF) between a length (L0) of the cavity 9 in the molding direction before the press molding is performed and a length (LF) of the obtained molded body in the molding direction is preferably within a range of 1.1 to 1.4. When the ratio L0/LF is 1.1 to 1.4, a risk that the alloy powder 21 of which magnetization direction is oriented to a direction of the magnetic field rotates by a force that is applied when the alloy powder is subjected to the press molding and thus the magnetization direction thereof deviates from a direction in parallel with the magnetic field, is redused thereby achieving a further improvement in magnetic characteristics. To obtain the ratio L0/LF of 1.1 to 1.4, for example, a method of increasing the concentration of the slurry to a high value (for example, concentration of 84% or more) is exemplified.

In the embodiment shown in FIG. 1(*c*) and FIG. 1(*d*), the lower punch 3 is fixed, and the upper punch 1 and the mold 5 are integrally moved to perform press molding in the magnetic field, but not limited to this as mentioned above.

FIG. 2 is a schematic view showing another embodiment of a press in the magnetic field. FIG. 2 shows a state where slurry supply has been completed and press molding will be initiated in a molding apparatus 200.

The upper punch 1A is vertically movable and the lower portion of the upper punch 1A is located in a throughhole of a mold 5.

The mold 5 is fixed and pressing in the magnetic field is carried out by moving the upper punch 1A and the lower punch 3 in the direction of an arrow P shown respectively (i.e. the upper punch 1A is moved in the lower direction, while the lower punch 3 is moved in the upper direction)

As a variation of the embodiment of FIG. 2, the mold 5 and the upper punch 1 are fixed, and the pressing in the magnetic field may be carried out by moving the lower punch 3 in the direction of an arrow P (upper direction).

Furthermore, the upper punch 1 is fixed, and pressing in the magnetic field may be carried out by integrally moving the mold 5 and the lower punch 3 in the upper direction.

2. Other Steps

Steps other than the molding step will be described below.

(1) Production of Slurry

Composition of Alloy Powder

An alloy powder may have the composition of a known rare earth sintered magnet including the R-T-B-based sintered magnet (R means at least one of rare earth elements (concept including yttrium (Y)), T means iron (Fe) or a combination of iron and cobalt (Co), and B means boron), and a samarium-cobalt-based sintered magnet.

An R-T-B-based sintered magnet is preferable because of the highest magnetic energy product among various magnets and the affordable low price.

Preferable composition of the R-T-B-based sintered magnet is shown below.

R is selected from at least one of Nd, Pr, Dy and Tb. However, it is preferable that R contains either one of Nd and Pr. It is more preferable that a combination of the rare earth elements represented by Nd—Dy, Nd—Tb, Nd—Pr—Dy or Nd—Pr—Tb is used.

Among R, Dy and Tb particularly exert the effect of improving $H_{cJ}$. The alloy powder may contain a small amount of another rare earth element, such as Ce or La, and, for example, Mischmetal or didymium, in addition to the above elements. The element R is not necessarily a pure element and may include inevitable impurities as long as it is available for industrial use. The content of the element R may be conventionally known content, and preferably can be in a range of 25 to 35% by mass. For the content of the element R of less than 25% by mass, the alloy powder cannot sometimes obtain the adequate magnetic characteristics, especially, the high $H_{cJ}$. On the other hand, for the content of the element R exceeding 35% by mass, the $B_r$ may be sometimes reduced.

The element T contains iron (including the case where T is substantially composed of iron), and may be substituted with cobalt (Co) by 50% by mass or less (including the case where T is substantially composed of iron and cobalt). The element Co is effective for improving the temperature characteristics and corrosion resistance, and the alloy powder may contain 10% by mass of less of Co. The content of the element T occupies the balance of R and B, or R and B and below-mentioned M.

The content of the element B may be known content, and preferably can be in a range of 0.9 to 1.2% by mass. For the content of the element B of 0.9% by mass or less, the alloy powder cannot sometimes obtain the high $H_{cJ}$. On the other hand, for the content of the element B exceeds 1.2% by mass, $B_r$ may be sometimes reduced. A part of the element B may be substituted with the element C (carbon). The substitution with the element C has the effect of improving the corrosion resistance of the magnet. In adding the elements B and C, the total content of the elements B and C is preferably controlled so as to have the above preferable content of the element B by converting the number of substituent C atoms into the number of B atoms.

In addition to the above elements, the element M can be added for improving $H_{cJ}$. The element M is at least one element selected from the group consisting of Al, Si, Ti, V, Cr, Mn, Ni, Cu, Zn, Ga, Zr, Nb, Mo, In, Sn, Hf, Ta and W. The amount of addition of the element M is preferably 2.0% by mass or less. When the addition amount of the element M exceeds 5.0% by mass, $B_r$ may be sometimes reduced. Inevetable impurities can be permitted.

Method for Producing Alloy Powder

The alloy powder is obtained in the following manner, for example, an ingot or a flake of a raw material alloy for a rare earth sintered magnet having a desired composition is produced by a melting method, and hydrogen is absorbed (occluded) in the ingot and the flake, thus performing hydrogen grinding to obtain a coarsely ground power.

Then, the coarsely ground power is further ground by a jet mill to obtain a fine powder (alloy powder).

A method for producing a raw material alloy for a rare earth sintered magnet will be exemplified below.

The alloy ingot is obtainable by an ingot casting method in which metal with finally required composition prepared in advance is melted and poured into a mold.

The alloy flake can be produced by a quenching method typified by a strip casting method or a centrifugal casting method in which a solidified alloy thinner than an alloy produced by an ingot casting method is quenched by bringing the molten metal into contact with a single roll, a twin roll, a rotation disk or a rotating cylinder mold.

In the present invention, a material produced by either one of the ingot casting method and the quenching method can be used. However, a material produced by the quenching method is preferred.

The raw material alloy (quenched alloy) for a rare earth sintered magnet, produced by the quenching method, usually has a thickness within a range of 0.03 mm to 10 mm and has a flake shape. The molten alloy starts solidification from a surface in contact with a cooling roll (roll contact surface), and a crystal grain grows into a columnar shape in a thickness direction from the roll contact surface. The quenched alloy is cooled within a shorter period of time as compared with the alloy (ingot alloy) produced by a conventional ingot casting method (mold casting method), and thus the structure is refined, leading to a small crystal grain size. The quenched alloy has a wide grain boundary area. Since an R-rich phase expands largely within the grain boundary, the quenching method is excellent in dispersibility of the R-rich phase.

Therefore, the quenched alloy is likely to undergo grain boundary fracture by the hydrogen grinding method. The hydrogen grinding of the quenched alloy can control an average size of the hydrogen-ground powder (coarsely ground power) within a range of 1.0 mm or less.

The coarsely ground power thus obtained is ground, for example, by a jet mill to obtain an alloy powder having a D50 grain size of 3 to 7 μm as measured by an airflow dispersion type laser analysis method.

The jet mill is preferably used in (a) atmosphere composed of a nitrogen gas and/or an argon gas (Ar gas) substantially having an oxygen content of 0% by mass, or (b) atmosphere composed of a nitrogen gas and/or an Ar gas having an oxygen content of 0.005 to 0.5% by mass.

In order to control the amount of nitrogen in the obtained sintered body, the atmosphere in the jet mill is replaced by an Ar gas atmosphere, and then a trace amount of a nitrogen gas is introduced thereinto to adjust the concentration of the nitrogen gas in the Ar gas.

Dispersion Medium

A dispersion medium is a liquid capable of obtaining a slurry by dispersing an alloy powder therein.

Examples of preferable dispersion medium to be used in the present invention include mineral oil and synthetic oil.

Although the kind of mineral oil or synthetic oil is not specified, when kinematic viscosity at normal temperature exceeds 10 cSt, the increased viscosity enhances cohesion between alloy powders, and thus an adverse influence may be sometimes exerted on orientation property of the alloy powder when wet molding is performed in magnetism.

Therefore, the kinematic viscosity at the normal temperature of mineral oil or synthetic oil is preferably 10 cSt or less. When a fractional distillation point of mineral oil or synthetic oil exceeds 400° C., it becomes difficult to perform deoiling after obtaining the molded body. As a result, the residual carbon amount in the sintered body may increase to cause deterioration of magnetic characteristics.

Therefore, the fractional distillation point of mineral oil or synthetic oil is preferably 400° C. or lower.

It is also possible to use vegetable oil as the dispersion medium. The vegetable oil means oil extracted from plants and is not limited to oil extracted from specific kinds of plants. Examples of the vegetable oil include soybean oil, rapeseed oil, corn oil, safflower oil and sunflower oil.

Preparation of Slurry

Slurry can be obtained by mixing the obtained alloy powder with a dispersion medium.

There is no particular limitation on a mixing ratio of the alloy powder to the dispersion medium, and the concentration of the alloy powder in the slurry is preferably 70% or more (i.e., 70% by mass or more) in terms of a mass ratio. This is because, the alloy powder can be efficiently supplied in the cavity at a flow rate within a range of 20 to 600 $cm^3$/second, and also excellent magnetic characteristics are obtained.

The concentration of the alloy powder in the slurry is preferably 90% or less in a mass ratio. This is because fluidity of the slurry is certainly ensured.

More preferably, the concentration of the alloy powder in the slurry is within a range of 75% to 88% in a mass ratio. This is because the alloy powder can be supplies more efficiently, and also fluidity of the slurry is ensured more certainly.

Still more preferably, the concentration of the alloy powder in the slurry is 84% or more in a mass ratio. As mentioned above, it is possible to adjust a ratio (L0/LF) of the length (L0) of the cavity 9 in molding direction to the length (LF) of the obtained molded body in the molding direction to a low value within a range of 1.1 to 1.4, thus enabling a further improvement in magnetic characteristics.

There is no particular limitation on the method for mixing the alloy powder with dispersion medium.

An alloy powder and a dispersion medium are separately prepared and, followed by weighing of predetermined amount of them to produce a mixture.

Alternatively, in the case of dry grinding of a coarsely ground powder by jet mill or the like to obtain an alloy powder, a container accommodating a dispersion medium is disposed at an alloy powder discharging opening of a grinder such as a jet mill, and the alloy powder obtained by grinding is directly collected in the dispersion medium accommodated in the container to obtain a slurry. In this case, it is preferable that the container is also placed under atmosphere composed of a nitrogen gas and/or an argon gas, and then obtained alloy powder is directly collected into the container of dispersion medium without exposing the alloy powder to atmospheric air to prepare a slurry.

It is also possible that the coarsely ground powder kept in dispersion medium is wet-ground in a state of being held in the dispersion medium using a vibration mill, a ball mill or an attritor to obtain a slurry composed of the alloy powder and the dispersion medium.

(2) Deoiling Treatment

A dispersion medium such as mineral oil or synthetic oil remains in the molded body obtained by the above mentioned wet molding method (longitudinal magnetic field molding method).

When the temperature of the molded body in this state is raised rapidly from normal temperature to, for example, 950 to 1,150° C., which is a sintering temperature, the inner temperature of the molded body rises rapidly, and thus the dispersion medium remaining in the molded body may react with a rare earth element of the molded body to produce rare earth carbide. In this way, when the rare earth carbide is produced, generation of a liquid phase sufficient for sintering is suppressed, thus failing to obtain a sintered body having sufficient density and leading deterioration of magnetic characteristics.

Therefore, before sintering, the molded body is preferably subjected to a deoiling treatment.

The deoiling treatment is preferably performed under the conditions at 50 to 500° C., and more preferably 50 to 250° C., under a pressure of 13.3 Pa ($10^{-1}$ Torr) or less for 30 minutes or more. This is because that the dispersion medium remaining in the molded body can be sufficiently removed.

A heating and holding temperature of the deoiling treatment is not limited to a single temperature as long as the heating and holding temperature is within a range of 50 to 500° C., and the deoiling treatment may be performed at two or more different temperatures. It is also possible to obtain the same effect as in the case of to the above mentioned preferable deoiling treatment by subjected to a deoiling treatment under the conditions of a pressure of 13.3 Pa ($10^{-1}$ Torr) or less and a temperature rise rate of from room temperature to 500° C. of 10° C./minute or less, an more preferably 5° C./minute or less.

(3) Sintering

Sintering of the molded body is preferably performed under a pressure of 0.13 Pa ($10^{-3}$ Torr) or less, and more preferably 0.74 Pa ($5.0\times10^{4}$ Torr) or less, at a temperature within a range of 1,000° C. to 1,150° C. In order to avoid oxidation by sintering, it is preferable to replace the remaining gas of atmosphere by inert gas such as helium and argon.

(4) Heat Treatment

The obtained sintered body is preferably subjected to a heat treatment. By the heat treatment, the magnetic characteristics can be enhanced. Publicly known conditions can be employed for the heat treatment, e.g., temperature of the heat treatment and time for the heat treatment.

EXAMPLES

Example 1 melting was cnducted by a high frequency melting furnace to obtain the composition of $Nd_{20.7}$, $Pr_{5.5}$, $Dy_{5.5}$, $B_{1.0}$, $Co_{2.0}$, $Al_{0.1}$, $Cu_{0.1}$ and a balance of Fe (% by mass), and the molten alloy was quenched by a strip casting method to obtain a flake-shaped alloy having a thickness of 0.5 mm. The alloy was coarsely ground by a hydrogen grinding method and then finely ground by a jet mill using a nitrogen gas having an oxygen content of 10 ppm (0.001% by mass, i.e., substantially 0% by mass). A particle diameter D50 of the obtained alloy powder was 4.7 μm. The alloy powder was immersed in mineral oil (manufactured by Idemitsu Kosan Co., Ltd. under the trade name of MC OIL P-02) having a fractional distillation point of 250° C. in a nitrogen atmosphere, and kinematic viscosity at room temperature of 2 cSt to prepare a slurry having a concentration (% by mass) shown in Table 1.

A parallel magnetic field molding apparatus shown in FIG. 1 was used for press molding. A mold having a cavity size measuring 145 mm in length and 145 mm in width was used as the mold. The depth (length in magnetic field application direction) of the cavity was set at 85 mm. After applying a static magnetic field having a magnetic field strength shown in Table 1 in a cavity in the depth direction of the cavity, a slurry was supped in a cavity 9 through a supply inlet 15 from a slurry supply device (not shown) under the conditions of the slurry concentration, the slurry flow rate and the slurry supply pressure shown in Table 1. After filling the cavity 9 with the slurry, press molding was performed under a molding pressure of 98 MPa (1 ton/$cm^2$) so that a ratio (L0/LF) of the length (L0) of the cavity to the length (LF) of a molded body after molding becomes the value shown in Table 1.

In Table 1, the slurry flow rate of sample No. 4 is the same as those of samples No. 3, 5, and 9, but the slurry supply pressure is different. Regarding sample No. 4, the same slurry flow rate is obtained under the slurry supply pressure different from those of samples Nos. 3, 5, and 9 by adjusting a pressure control valve of a hydraulic system and changing the slurry supply pressure and also adjusting a slurry flow rate regulating valve.

When the slurry flow rate is 15 $cm^2$/second (sample No. 1), a slurry could not be supplied in a cavity due to piping resistance, thus failing to perform press molding. When the slurry flow rate is 700 $cm^2$/second (sample No. 8), cracks occurred at the time of removing a molded body after press molding, thus failing to perform sintering.

TABLE 1

| Sample Nos. | Slurry concentration (%) | Magnetic field strength (T) | Slurry flow rate ($cm^3$/second) | Slurry suppy pressure (MPa) | L0/LF | Remarks |
|---|---|---|---|---|---|---|
| 1 | 85 | 1.5 | 15 | 5.88 | — | Comparative Example |
| 2 | 85 | 1.5 | 20 | 5.88 | 1.25 | Present invention |
| 3 | 85 | 1.5 | 200 | 5.88 | 1.25 | Present invention |
| 4 | 85 | 1.5 | 200 | 2.94 | 1.25 | Present invention |

TABLE 1-continued

| Sample Nos. | Slurry concentration (%) | Magnetic field strength (T) | Slurry flow rate ($cm^3$/second) | Slurry suppy pressure (MPa) | L0/LF | Remarks |
|---|---|---|---|---|---|---|
| 5 | 85 | 1.5 | 200 | 5.88 | 1.45 | Present invention |
| 6 | 85 | 1.5 | 400 | 5.88 | 1.25 | Present invention |
| 7 | 85 | 1.5 | 600 | 5.88 | 1.25 | Present invention |
| 8 | 85 | 1.5 | 700 | 5.88 | 1.25 | Comparative Example |
| 9 | 85 | 1.0 | 200 | 5.88 | 1.25 | Comparative Example |

The temperature of the obtained molded bodies of samples Nos. 2 to 7 and 9 was raised to 150° C. from room temperature at 1.5° C./minute in vacuum. After maintaining at the same temperature for 1 hour, the temperature was raised to 500° C. at 1.5° C./minute to remove mineral oil in the molded bodes, and then the temperature was raised to 1,100° C. from 500° C. at 20° C./minute, followed by sintering by maintaining at the same temperature for 2 hours. The obtained sintered body was subjected to a heat treatment at 900° C. for 1 hour, followed by a heat treatment at 600° C. for 1 hour.

Magnet samples, each having a cubic shape (as shown in FIG. 3, side of a cube is in parallel with the magnetic field application direction) of 7 mm in side, were cut out from 12 positions shown in FIG. 3 of the obtained sintered magnet having a shape shown in FIG. 3, and then magnetic characteristics ($B_r$, $H_{cJ}$) of each magnet sample were measured by a BH tracer.

Arrow B in FIG. 3 indicates the direction of a magnetic field applied at the time of press molding.

Among 12 positions shown in FIG. 3, 1U, 2U, 3U and 4U correspond to the vicinity of the respective four corners of a molded body in contact with an upper punch 1 at the time of press molding, and 5U corresponds to the vicinity of the center of the top face. 5M corresponds to the vicinity of the center of the molded body, and 6S corresponds to the vicinity of a supply inlet 15. 1L, 2L, 3L and 4L correspond to the respective four corners of the lower face of the molded body in contact with a lower punch 3 at the time of press molding, and 5L corresponds to the vicinity of the center of a lower face.

The value of the residual magnetic flux density $B_r$ is shown in Table 2. Each magnet had a coercive force $H_{cJ}$ within a range of 1,710 to 1,790 kA/m.

TABLE 2

| Sample | $B_r$ (T) | | | | | | | | | | | | |
|---|---|---|---|---|---|---|---|---|---|---|---|---|---|
| Nos. | 1U | 2U | 3U | 4U | 5U | 5M | 1L | 2L | 3L | 4L | 5L | 6S | Remarks |
| 1 | — | — | — | — | — | — | — | — | — | — | — | — | Comparative Example |
| 2 | 1.33 | 1.32 | 1.32 | 1.33 | 1.33 | 1.33 | 1.34 | 1.34 | 1.34 | 1.34 | 1.34 | 1.34 | Present invention |
| 3 | 1.33 | 1.32 | 1.32 | 1.33 | 1.33 | 1.33 | 1.34 | 1.34 | 1.34 | 1.34 | 1.34 | 1.34 | Present invention |
| 4 | 1.33 | 1.32 | 1.32 | 1.33 | 1.33 | 1.33 | 1.34 | 1.34 | 1.34 | 1.34 | 1.34 | 1.34 | Present invention |
| 5 | 1.31 | 1.31 | 1.31 | 1.31 | 1.33 | 1.33 | 1.34 | 1.34 | 1.34 | 1.34 | 1.34 | 1.34 | Present invention |
| 6 | 1.32 | 1.32 | 1.32 | 1.32 | 1.33 | 1.33 | 1.34 | 1.34 | 1.34 | 1.34 | 1.34 | 1.33 | Present invention |
| 7 | 1.32 | 1.32 | 1.32 | 1.32 | 1.32 | 1.33 | 1.34 | 1.33 | 1.33 | 1.34 | 1.34 | 1.32 | Present invention |
| 8 | — | — | — | — | — | — | — | — | — | — | — | — | Comparative Example |
| 9 | 1.32 | 1.31 | 1.31 | 1.32 | 1.32 | 1.32 | 1.33 | 1.33 | 1.33 | 1.33 | 1.33 | 1.33 | Comparative Example |

As shown in Table 2, sintered magnets (samples Nos. 2 to 7) of the present invention based on a molded body obtained by supplying a slurry in a cavity, to which a magnetic field of 1.5 T or more is applied, at a flow rate of 20 to 600 $cm^3$/second, followed by press molding, exhibit high $B_r$ and also exhibit almost uniform $B_r$ in each portion of a single magnet body. As is apparent from a comparison between sample No. 3 and sample No. 4, if the slurry flow rate is the same, uniformity of $B_r$ in each portion of a single magnet body changes nothing even if the slurry supply pressure is changed. As is apparent from a comparison between sample No. 3 and sample No. 5, sample No. 3 with L0/LF within a range of 1.1 to 1.4 exhibits uniform $B_r$ in each portion of a single magnet body.

On the other hand, like sample No. 9, when the magnetic field strength is less than 1.5 T, the orientation degree of an alloy powder deteriorates, and thus $B_r$ entirely decreases.

Example 2

In the same manner as in Example 1, except that a mold 5 with a cavity having an approximately arc-shaped cross section measuring 35 mm in R width, 15 mm in R height and 8 mm in wall thickness was used as a mold and the depth (length in magnetic field application direction) of the cavity was set at 80 mm, press molding was performed under the same conditions using the same slurry as in sample No. 3 of Example 1. The obtained molded body was sintered under the same conditions as in Example 1 to obtain a long sintered magnet whose cross section has an approximately arc shape.

Magnet samples, each having a cubic shape of 3 mm in side, the side of the cube being in parallel with the magnetic field application direction (direction of an arrow B of FIG. 4), were cut out from 12 positions shown in FIG. 4 of the obtained sintered magnet, and then magnetic characteristics ($B_r$, $H_{cJ}$) of each magnet sample after cutting out were measured by a BH tracer.

Arrow B of FIG. 4 indicates the direction of the magnetic field applied at the time of press molding.

Among 12 positions shown in FIG. 4, 1U, 2U, 3U, 4U and 5U correspond to the vicinity of a top face of a molded body in contact with an upper punch 1 at the time of press molding, 1U and 4U correspond to the vicinity of the end of an approximately arc-shaped outer peripheral surface, 2U and 3U correspond to the vicinity of the end of an approximately arc-shaped inner peripheral surface, and 5U corresponds to the vicinity of the center of a top face. 1L, 2L, 3L, 4L, and 5L correspond to the vicinity of a lower face of a molded body in contact with a lower punch 3 at the time of press molding, 1L and 4L correspond to the vicinity of the end of an approximately arc-shaped outer peripheral surface, 2L and 3L correspond to the vicinity of the end of an approximately arc-shaped inner peripheral surface, and 5L corresponds to the vicinity of the center of a lower face. 5M corresponds to the vicinity of the center of a molded body, and 6S corresponds to the vicinity of a supply inlet 15.

The value of $B_r$ is shown in Table 3. Each magnet had $H_{cJ}$ within a range of 1,710 to 1,790 kA/m.

TABLE 3

| Sample | $B_r$ (T) | | | | | | | | | | | | |
|---|---|---|---|---|---|---|---|---|---|---|---|---|---|
| No. | 1U | 2U | 3U | 4U | 5U | 5M | 1L | 2L | 3L | 4L | 5L | 6S | Remarks |
| 10 | 1.33 | 1.32 | 1.32 | 1.33 | 1.33 | 1.33 | 1.34 | 1.34 | 1.34 | 1.34 | 1.34 | 1.34 | |

As shown in Table 3, a sintered magnet (sample No. 10) of the present invention based on a molded body obtained by supplying a slurry in a cavity, to which a magnetic field of 1.5 T or more is applied, at a flow rate of 200 $cm^3$/second, followed by press molding, exhibits high $B_r$ and also exhibits almost uniform $B_r$ in each portion of a single magnet body. According to the parallel magnetic field molding method, since the shape orthogonal to the magnetic field direction (cavity shape of mold) has the degree of freedom, it is possible to easily produce a long molded article, which is used as a magnet for voice coil motors of a hard disk drive in recent days, having a large size in the magnetic field application direction and also having a complicated cross-sectional shape in the direction orthogonal to the magnetic field application direction, for example, a shape whose cross section has an approximately arc shape, protrusions being formed on at least a part of an outer R surface (approximately arc-shaped outer peripheral surface), an inner R surface (approximately arc-shaped inner peripheral surface), and an arc end face, by the parallel magnetic molding method.

Comparative Example 1

Using the same alloy powder as in Example 1, press molding was performed in atmospheric air by a parallel magnetic field molding method using a dry molding method. A mold having a cavity size measuring 55 mm in length and 40 mm in width was used. The depth (length in magnetic field application direction) of the cavity was set at 8 mm.

Regarding press molding, a cavity is filled with an alloy powder and the cavity was closed by descending an upper punch. After applying a static magnetic field having a magnetic field strength of 1.0 T to the depth direction of the cavity, the upper punch was further descended and then press molding was performed under a molding pressure of 98 MPa (1 ton/$cm^2$) so that a ratio (L0/LF) of the length (L0) of the cavity to the length (LF) of a molded body after molding becomes 1.7.

The obtained molded body was sintered under the same conditions as in Example 1 to obtain a sintered magnet (sample No. 11).

Magnet samples, each having a cubic shape of 3 mm in side (side of a cube is in parallel with the magnetic field application direction), was cut out from the obtained sintered magnet, and then magnetic characteristics ($B_r$, $H_{cJ}$) of each magnet sample after cutting out were measured by a BH tracer. As a result, $B_r$ was 1.23 T, and $H_{cJ}$ was 1,750 kA/m.

As mentioned above, the sintered magnet obtained by the parallel magnetic field molding method using the dry molding method exhibits decreased $B_r$ as compared with the sintered magnet of the present invention. This is because the alloy powder and the molded body are oxidized when an alloy powder is supplied in a cavity or a molded body is removed after completion of press molding, leading to an increase in amount of oxygen of the molded body, and also the orientation degree of the alloy powder is not higher than that in the wet molding method.

Comparative Example 2

Using the same alloy powder as in Example 1, press molding was performed in atmospheric air by a perpendicular magnetic field molding method using a dry molding method. A mold having a cavity size measuring 64 mm in length and 5 mm in width was used. The depth (length in magnetic field application direction) of the cavity was set at 54 mm. The 5 mm direction is the magnetic field application direction.

Regarding press molding, a cavity was filled with an alloy powder and the cavity was closed by descending an upper punch. After applying a static magnetic field having a magnetic field strength of 1.0 T to the depth direction of the cavity, the upper punch was further descended and then press molding was performed under a molding pressure of 98 MPa (1 ton/$cm^2$) so that a ratio (L0/LF) of the length (L0) of the cavity to the length (LF) of a molded body after molding becomes 2.2.

The obtained molded body was sintered under the same conditions as in Example 1, a sintered magnet (sample No. 12) was obtained. Magnet samples, each having a cubic shape of 3 mm in side (side of a cube is in parallel with the magnetic field application direction), was cut out from the obtained sintered magnet, and then magnetic characteristics ($B_r$, $H_{cJ}$) of each magnet sample after cutting out were measured by a BH tracer. As a result, $B_r$ was 1.30 T, and $H_{cJ}$ was 1,750 kA/m.

As mentioned above, the sintered magnet obtained by the perpendicular magnetic field molding method using the dry molding method exhibits slightly decreased $B_r$ as compared with the sintered magnet of the present invention. On the other hand, $B_r$ is improved as compared with the sintered magnet obtained by the parallel magnetic field molding method using the dry molding method of Comparative Example 1. This is because the perpendicular magnetic field molding method enables molding without disturbing the orientation of an alloy powder oriented in the magnetic field application direction as compared with the parallel magnetic field molding method.

Comparative Example 3

Using the same slurry as in sample No. 3 of Example 1, press molding was performed by a perpendicular magnetic field molding method using a wet molding method. A mold having a cavity size measuring 60 mm in length and 40 mm in width was used. The depth of the cavity was set at 55 mm. The width (40 mm) direction is the magnetic field application direction.

Regarding press molding, an upper punch was descended to form a cavity and a static magnetic field having a magnetic field strength of 1 T in the cavity in the cavity width direction (40 mm direction), and then a slurry was supplied in the cavity through a supply inlet under the conditions of a slurry flow rate of 400 $cm^3$/second and a slurry supply pressure of 5.88 MPa (60 $kgf/cm^2$) from a slurry supply device.

After filling the cavity with the slurry, press molding was performed under a molding pressure of 39 MPa (0.4 ton/$cm^2$) so that a ratio (L0/LF) of the length (L0) of the cavity to the length (LF) of the molded body after molding becomes 1.45. The obtained molded body was sintered under the same conditions as in Example 1 to obtain a sintered magnet (sample No. 13).

Magnet samples, each having a cubic shape of 7 mm in side (as shown in FIG. 5, a side of a cube is in parallel with the magnetic field application direction), were cut out from 10 positions I to X shown in FIG. 5 of the obtained sintered magnet, and then magnetic characteristics ($B_r$, $H_{cJ}$) of each magnet sample after cutting out were measured by a BH tracer.

Arrow B of FIG. 5 indicates the direction of the magnetic field applied at the time of press molding.

Among 10 positions shown in FIG. 5, I, II, III, IV and V correspond to the vicinity of a top face of a molded body in contact with the upper punch at the time of press molding. As is apparent from FIG. 5, I to V are linearly arranged, in which III corresponds to the vicinity of the center, while I and V corresponds to the vicinity of the end. VI, VII, VIII, IX and X correspond to the vicinity of a lower face in the vicinity of a molded body in contact with a lower punch at the time of press molding. As is apparent from FIG. 5, VI to X are linearly arranged, VIII corresponds to the vicinity of the center, and VI and X corresponds to the vicinity of the end.

The value of $B_r$ is shown in Table 4. The magnets I to X had $H_{cJ}$ within a range of 1,710 to 1,790 kA/m.

TABLE 4

| | $B_r$ (T) | | | | | | | | | | |
|---|---|---|---|---|---|---|---|---|---|---|---|
| No. | I | II | III | IV | V | VI | VII | VIII | IX | X | Remarks |
| 13 | 1.29 | 1.31 | 1.33 | 1.31 | 1.29 | 1.30 | 1.32 | 1.34 | 1.32 | 1.30 | Comparative Example |

As shown in Table 4, high $B_r$ is obtained in the center III of the upper side of the magnet, and $B_r$ decreases as it travels to the upper end side of the magnet. This is because, when the cake layer is formed on an upper portion in the cavity in an initial stage of press molding, the magnetic permeability of the portion increases, thus causing focusing of the magnetic field in the cake layer and curved magnetic field, leading to deterioration of the orientation degree of an alloy powder at the magnet end in magnetic field application direction. In case the size of the cavity in the magnetic field application direction is comparatively small (10 mm or less), such phenomenon does not occur remarkably in the present Comparative Example. However, since the size of the cavity in the magnetic field application direction is comparatively large, for example, 40 mm, such phenomenon occurred. According to the present invention, as shown in Examples 1 and 2, it is possible to easily produce a rare earth sintered magnet having uniform and high magnetic characteristics in each portion of a single magnet body even if the cavity (depth size of cavity) in the magnetic field application direction has a large size.

This application claims priority on Japanese Patent Application No. 2012-146704, the disclosure of which is incorporated by reference herein.

DESCRIPTION OF REFERENCE NUMERALS

1, 1A Upper punch
3 Lower punch
5 Mold
7 Electromagnet
9 Cavity
11 Dispersion medium outlet
13 Filter
15 Supply inlet
21 Alloy powder
23 Dispersion medium
25 Slurry
27 Cake layer

The invention claimed is:

1. A method for producing a rare earth sintered magnet, comprising the steps of:

1) preparing a slurry including an alloy powder and a dispersion medium at a predetermined ratio, the alloy powder containing a rare earth element, iron and boron;

2) preparing a cavity enclosed with a mold, and an upper punch and a lower punch, at least one of the upper punch and the lower punch being movable toward and away from the other one in the mold, at least one of the upper punch and the lower punch including an outlet for discharging the dispersion medium of the slurry;

3) applying a magnetic field of 1.5 T or more in the cavity in the direction parallel to the direction in which at least one of the upper punch and the lower punch is movable, and supplying the slurry at a flow rate of 20 to 600 $cm^3$/second to fill the cavity with the slurry;

4) producing a molded body of the alloy powder by press molding in the magnetic field, the upper punch and the lower punch coming closer to each other while applying the magnetic field; and 5) sintering the molded body;

wherein the cavity has a length of 10 mm or more in the direction in which at least one of the upper punch and the lower punch is movable, the slurry has a concentration of 84 to 90% by mass of the alloy powder, and in the direction in which at least one of the upper punch and the lower punch is movable, a ratio (L0/LF) of the length (L0) of a cavity before press molding in the magnetic field to the length (LF) of the molded body is within a range of 1.1 to 1.4.

2. The method for producing a rare earth sintered magnet according to claim 1, wherein the flow rate of the slurry is within a range of 20 to 400 $cm^3$/second.

3. The method for producing a rare earth sintered magnet according to claim 1, wherein the flow rate of the slurry is within a range of 20 to 200 $cm^3$/second.

4. The method for producing a rare earth sintered magnet according to claim 1, wherein the flow rate of slurry is 200 to 600 $cm^3$/second.

* * * * *